United States Patent [19]

Bilardi et al.

[11] 4,154,017

[45] May 15, 1979

[54] TETHERED FLYING TOY

[76] Inventors: Anthony F. Bilardi; Richard E. Merwin, both of 3646 Kerner Blvd., San Rafael, Calif. 94901

[21] Appl. No.: 845,821

[22] Filed: Oct. 27, 1977

[51] Int. Cl.[2] ..... A63H 27/04

[52] U.S. Cl. ..... 46/75; 46/79; 244/154

[58] Field of Search ..... 46/75, 76 R, 79, 82; 244/154

[56] References Cited

U.S. PATENT DOCUMENTS

| | | | |
|---|---|---|---|
| 2,257,298 | 9/1941 | Hahn | 244/154 |
| 3,079,116 | 2/1963 | Trimble | 46/75 |
| 3,514,059 | 5/1970 | Aalto | 46/75 |

*Primary Examiner*—Louis G. Mancene
*Assistant Examiner*—Robert F. Cutting
*Attorney, Agent, or Firm*—Owen, Wickersham & Erickson

[57] ABSTRACT

A ground controlled tethered flying autogiro toy utilizing a single auto rotating wing for its sole means of aerodynamic lift. The wing is attached to a greatly simplified space frame structure that makes the toy capable of controllable aerobatic maneuvers.

12 Claims, 10 Drawing Figures

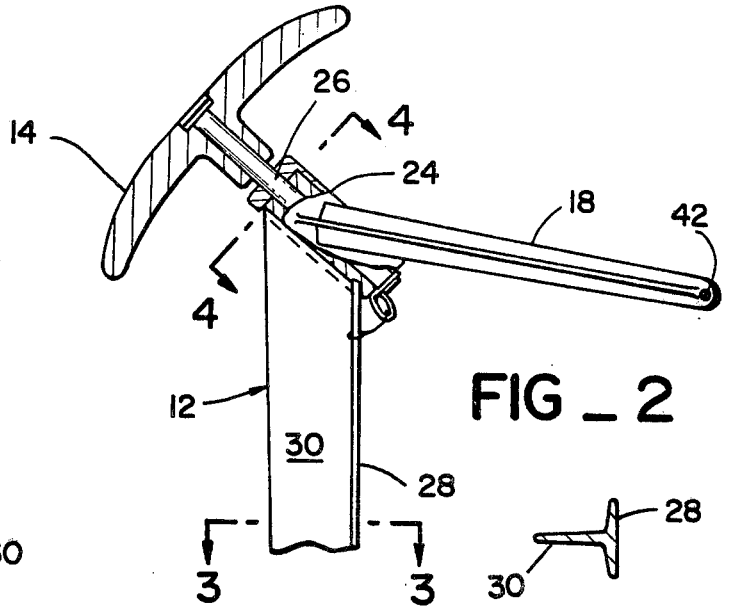
FIG_2
FIG_3
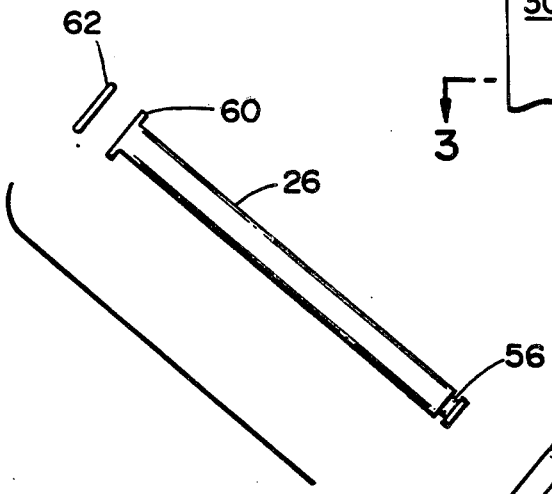
FIG_5
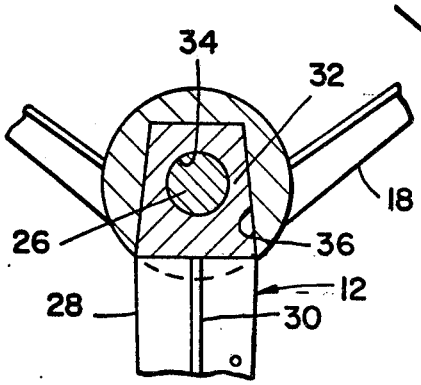
FIG_4
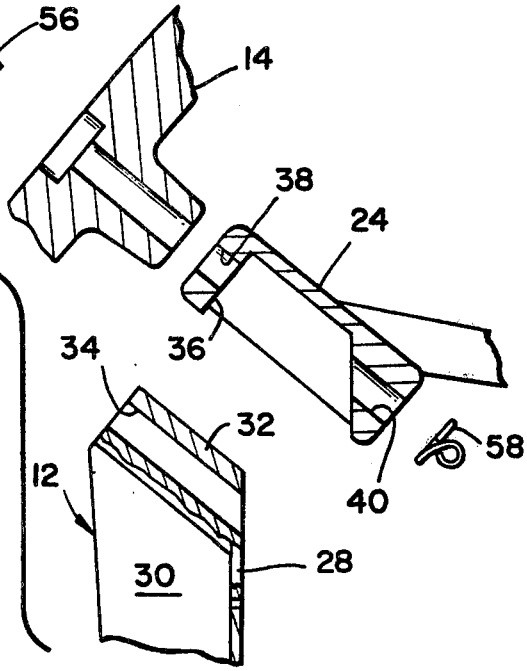

TETHERED FLYING TOY

This invention relates to a flying, wind driven autogiro toy that can be controlled and maneuvered, while tethered, by a person on the ground.

BACKGROUND OF THE INVENTION

In the field of tethered airborne toys or kites previous attempts have been made to provide such devices using rotating propellers or rotors and the like. Examples of such devices are found in the U.S. patents to Bradford Nos. (1,824,324), Waldock (2,136,717), Carrasco (2,222,402) and Dunn (2,442,846). However, all such prior devices were limited to merely maintaining themselves airborne in a prevailing wind when tethered by a single control line held by the ground operator. Thus, none of these prior art devices were capable of or even attempted to accomplish aerobatic maneuvers which could greatly enhance the interest and excitement of the operator. All of the first three of the above noted patented devices combined various wing or other aerodynamic surface components to provide typical wind kite effects. The Dunn patent sought to increase stability using smaller control surfaces and separate "lift" and "drive" propellers. However, such a device also failed to provide controllable maneuverability and it was obviously complicated in structure as well as in operability.

SUMMARY OF THE PRESENT INVENTION

It is a general object of the present invention to overcome the disadvantages and limitations of the above mentioned prior art toys or kites by providing a tethered device that utilizes only a rotating wing for lift and is controllably maneuverable by the ground operator.

Another object of the present invention is to provide a tethered, rotating wing toy that is easily controllable by two control lines to perform desired maneuvers.

Yet another object of the present invention is to provide a tethered, rotating wing toy that utilizes a rotating wing for lift in a prevailing wind with no other aerodynamic lifting surfaces.

Another object of the present invention is to provide a tethered, rotating wing toy that can be produced in knock-down kit form and then be easily assembled by the user.

Still another object of the present invention is to provide a tethered, rotating wing toy that is particularly well adapted for ease and economy of manufacture.

According to the invention, the aforesaid objects are accomplished by a device comprising a slender body having an enlarged head portion at its upper end and a rudder control surface at its lower end. Journaled for rotation in the enlarged head portion is a rotating wing having a central hub from which extend one or more suitable lifting airfoil sections. Extending forwardly, outwardly and somewhat downwardly from the enlarged body head portion are two tiller struts. Attached to one end of each tiller strut is a flexible bridle line and the lower ends of these two bridle lines are attached to opposite sides of the fixed rudder control surface. Between the upper and lower ends of the bridle lines are attached the control lines which extend downwardly to the ground operator.

The plane of rotation of the lifting rotor wing is tilted backwardly so that it intersects the longitudinal axis of the body at an angle of less than 90°. In flight in a prevailing wind the auto rotation of the rotor provides aerodynamic lift which sustains the device in the air, and the control lines are manipulated to maneuver it. Fairly rapid increases in tension of one control line will cause a tipping of the body and hence a similar tipping of the rotating wings plane of rotation and its lift vector. This initiates a rolling maneuver which can be controllably terminated by reversing the tension on the control lines. Other maneuvers of the airborne device can be performed by various manipulations of the two control lines.

Other objects, advantages and features of the present invention will become apparent from the following detailed description of one embodiment, presented in conjunction with the accompanying drawing.

BRIEF DESCRIPTION OF THE DRAWING

FIG. 2 is a fragmentary view in side elevation of the autogiro toy of FIG. 1;

FIG. 3 is a view in section taken along line 3—3 of FIG. 2;

FIG. 4 is a view in section taken along line 4—4 of FIG. 2;

FIG. 5 is an exploded view in side elevation of the autogiro toy of FIG. 1;

DETAILED DESCRIPTION OF PREFERRED EMBODIMENT

Figure 1:
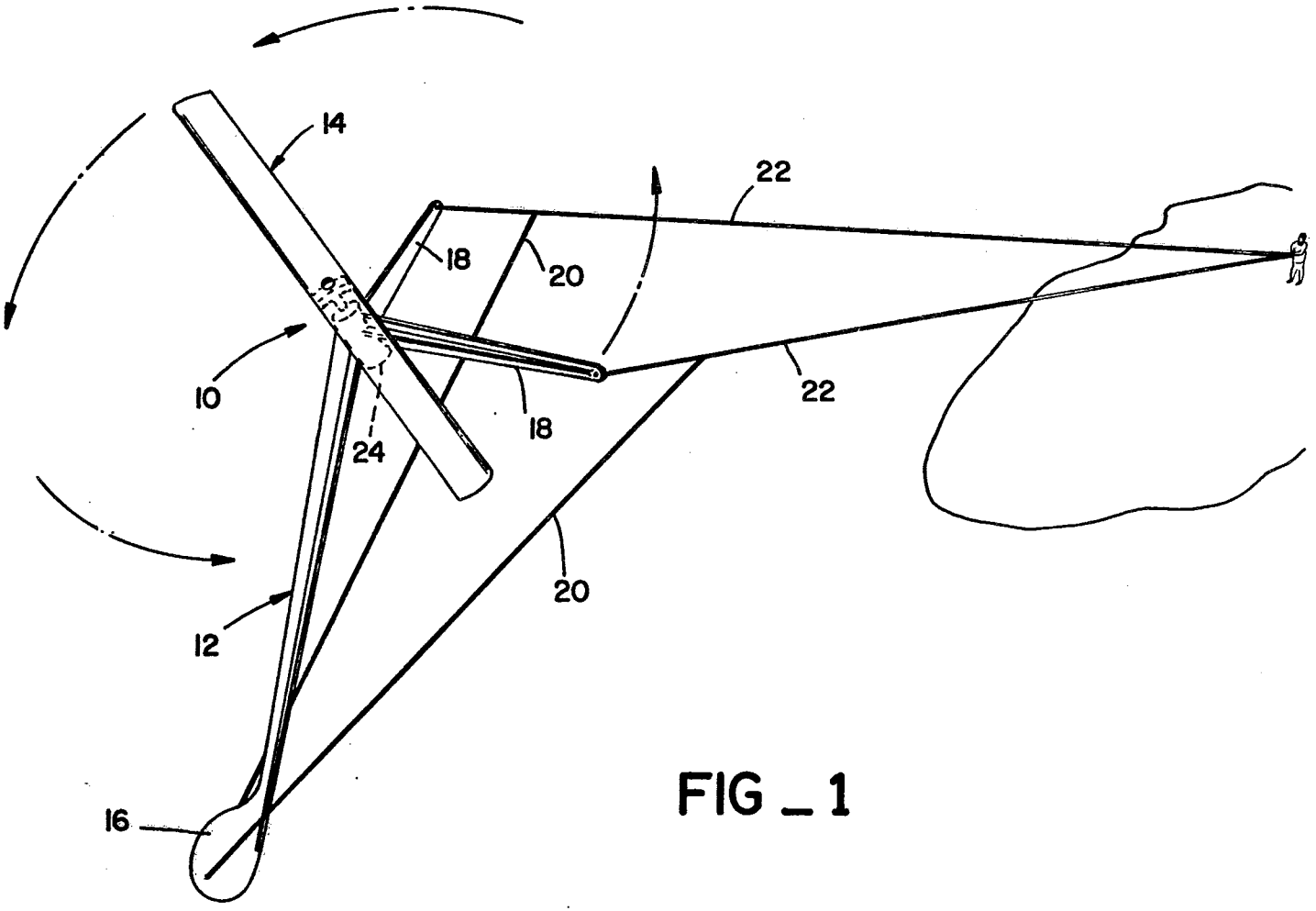
FIG. 1 is a view in perspective showing an autogiro toy according to the present invention as it appears when in flight.
Figure 6:
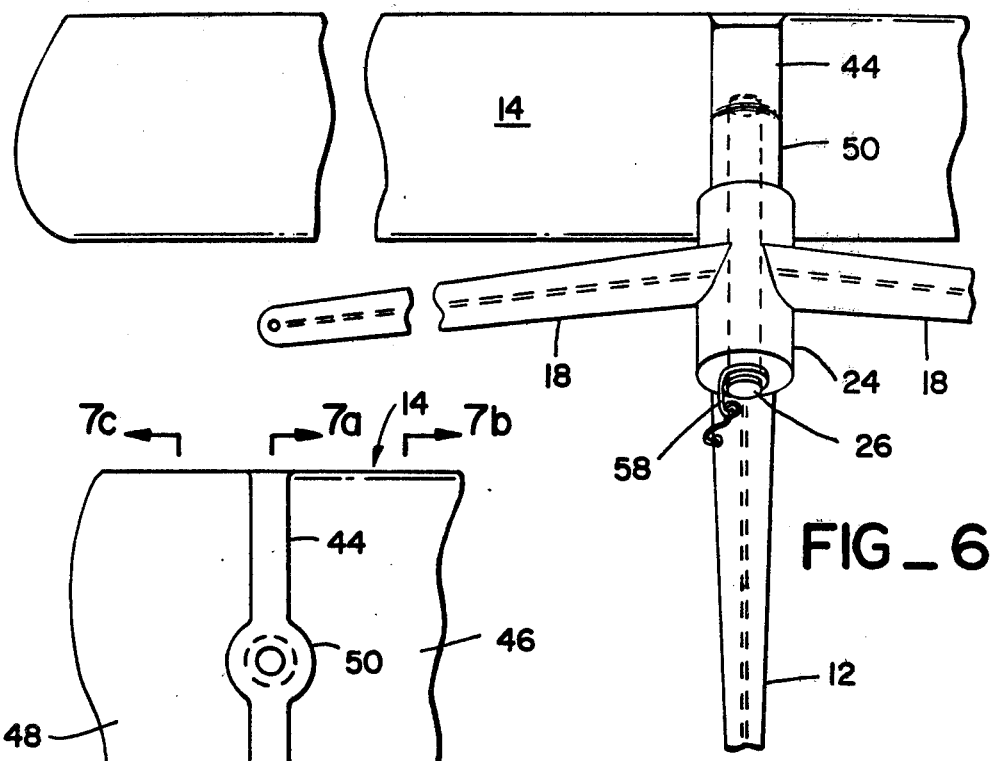
FIG. 6 is a fragmentary front view in elevation of our autogiro toy with portions broken away.

With reference to the drawing, FIG. 1 shows an autogiro flying toy 10 embodying the principles of the present invention as it appears when operated in flight by a person on the ground. As a toy, the device may be controlled in a wide range of wind conditions by a relatively unskilled person to perform aerobatic maneuvers that are highly entertaining to both the operator and observers.

In general, the device comprises a slender body 12 that supports a rotatable wing 14 at its upper end and a control and stabilizing rudder 16 at its lower end. Extending outwardly and somewhat forwardly from the body near its upper end are two tiller struts 18, and to the end of each strut is attached one end of a flexible bridle line 20 whose lower end is fixed to the rudder 16. A control line 22 attached to each bridle line 20 extends to the operator who can hold one control line in each hand.

In the embodiment illustrated, our toy device is preferably comprised of three sections which are separately molded from a suitable plastic material such as ABS or polypropylene. These three sections comprise (1) the rotatable wing 14; (2) the slender body 12 having the rudder 16 integrally attached; and (3) an interconnected section comprised of a hub member 24 with the outwardly extending tiller struts 18 integrally attached thereto. When assembled for flight, all three of these sections are held together by a single rigid pin or shaft 26, and the assembly can be accomplished quickly and easily by a person of low skill.

The autogiro body 12, as shown in FIG. 1, has a long and slender portion with a T-shaped cross-section that provides a high strength factor with relatively low weight. The T-shaped cross-section is formed by a flat base portion 28 that is normally transverse to the prevailing wind direction during flight and tapers in width from the top end of the body to the lower end thereof. A thin, vertical flange portion 30 on the body extends perpendicular to the base portion, and rearwardly from its longitudinal center line. Near its lower end, the vertical flange portion enlarges into an integral and somewhat elliptical shaped surface forming the rudder 16. The edges of the base portion are tapered into the sides of this rudder surface, so that a substantial portion of the rudder's leading edge is directly exposed to the prevailing wind in flight.

At its upper end, the T-shaped body portion is integrally connected with an enlarged head portion 32 which is provided to facilitate its attachment to the hub member 24. As shown in FIG. 5, the longitudinal axis of this head portion slopes downwardly and forwardly at an angle with respect to the longitudinal axis and the base portion of the slender body portion. Formed within this head portion is a cylindrical bore 34. In the embodiment shown, the slope angle between the axis of this forwardly and downwardly tilting cylindrical bore and the base portion 28 of the body 12 is around 45°. The opposite sides of the enlarged head portion 32 of the body are not parallel, but are slightly convergent toward their upper side at a small angle (e.g. 3–5 degrees). Thus, the head portion is somewhat wedge shaped in cross section as shown in FIG. 4, and it is adapted to fit within a similarly wedged shaped cavity 36 within the hub member 24.

Outwardly, the hub member 24, as shown in FIG. 5, has a generally cylindrical configuration with the aforesaid cavity 36 formed on its underside between opposite end portions. These end portions are both provided with bore holes 38 and 40 which are axially aligned with the bore hole 34 in the wedge shaped head portion 32 of the body 12 when the body and hub member 24 are assembled.

Integral with and extending outwardly and forwardly from the hub member are the tiller struts 18. As shown, these struts are also preferably molded with a T-shaped cross section in order to provide maximum strength and rigidity with minimum weight. At their outer ends, each strut 18 is provided with a small hole 42 through which the end of a bridle 20 can be attached.

Figure 7:
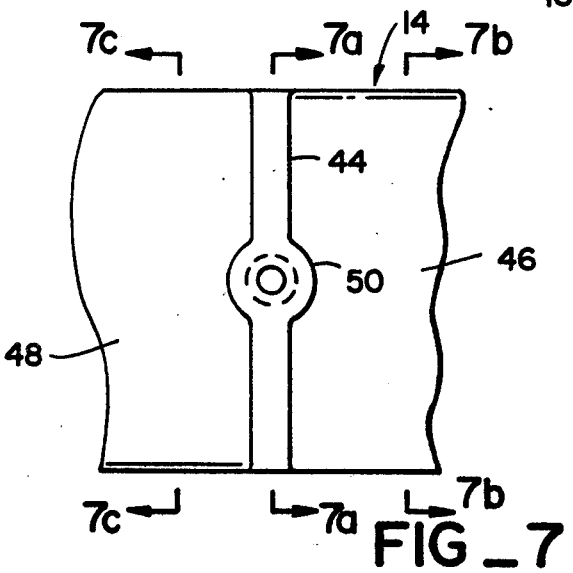
FIG. 7 is an enlarged fragmentary view of the rotor hub section taken from its underside.
Figure 7A:
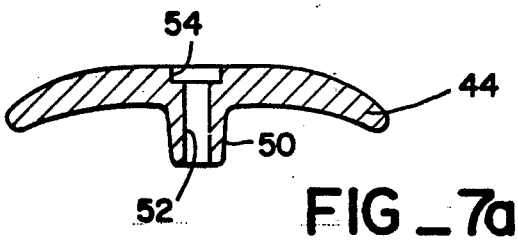
FIG. 7*a* is a view in section taken along line 7*a*—7*a* of FIG. 7.
Figure 7B:
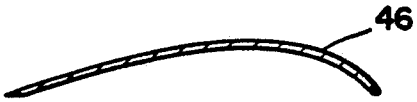
FIG. 7*b* is a view in section taken along line 7*b*—7*b* of FIG. 7.
Figure 7C:
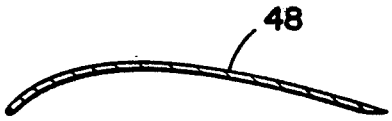
FIG. 7*c* is a view in section taken along line 7*c*—7*c* of FIG. 7.

The rotatable wing 14 is also preferably molded as an integral component from plastic material, and as shown in FIG. 7, it comprises a relatively thick central section 44 with relatively thin airfoil sections 46 and 48 extending from opposite sides thereof. The central section includes a downwardly extending boss portion 50 located mid way between its leading and trailing edges with a bore hole 52, and this bore hole has an enlarged countersunk portion 54 at its upper end. The airfoil sections extending from the central section each have substantially a uniform thickness with an upper cambered surface having a suitable airfoil shape that provides aerodynamic lift at relatively low speed, such as found on the NASA GAW-1, airfoil shape. For added strength and rigidity both sections may be molded with leading and trailing edges having a slightly increased thickness and in some instances an integral rib may be provided for added stiffening. On opposite sides of the central section the airfoil sections face in opposite directions, so that as the wing 14 rotates the leading edge of each section is also moving toward the relative wind.

The wing 14 is rotatable about the cylindrical pin or shaft 26 which extends through the bore 52 in the wing central section 44, the end bores 38 and 40 in the hub-member 24 and the bore 34 in the head portion 32 of the body 12. Thus, as shown in FIG. 5, the shaft 26 serves to hold together the three main sections of the toy when it is assembled for use. The lower end of the shaft projects outside the lower end of the hub member and has an annular groove 56 for a snap-ring retainer 58. The upper end of the shaft extends into the enlarged bore portion 54 of the wing 14, and is there retained by a washer 60 that is press fitted or swedged to the end of the shaft. A thin, flexible plastic dust cover 62 may be provided in the enlarged bore over the washer. The shaft which is preferably made of a hard steel, is sized to provide a smooth running fit with the wing bore 52. If necessary, a suitable lubricant such as a well-known silicone compound may be provided within the wing bore to reduce running friction.

From the foregoing description it should be apparent that our tethered flying toy may be easily assembled for flight by even a child having no special skill. The head portion 32 of the slender body 12 is first inserted into the cavity 36 of the hub member 24 so that the bore holes of each component are in alignment. Now, with the wing 14 in its operating position, the shaft 26 with its washer 60 in place at its upper end is inserted through its bore hole and those of the hub member and body, and the retainer 58 is snapped onto the lower end of the shaft. When the bridle lines 20 with the control lines 22 already attached are connected to the tiller struts 18 and the rudder 16, the toy is ready to be flown.

In operation, a flight with the toy 10 can commence by first holding the body 12 substantially vertical with its rotating wing 14 in the path of a prevailing wind, and allowing the wing to rotate up to speed. When its speed reaches the point at which its airfoil sections are producing adequate lift, the toy may be released and will rise as the operator maintains tension on the control lines 22. When airborne, the kite is controlled in yaw by applying tension through the control lines to the tiller struts 18.

Under a wide range of wind conditions, the device 10 will maintain stabilized flight, due to lift created by the rotating wing 14 whose axis of rotation is tilted backwardly relative to the slender body 12. This, coupled with the arrangement wherein the tiller struts 18 extend forwardly and outwardly from the body 12 and from the plane of rotation of the wing provides remarkable flying stability. Also, we discovered that by locating the ends of the tiller struts below the plane of rotation, the bridle tension on the tiller struts, transmitted from the control lines, tends to counteract any tendency for the device to pitch backwardly into a vertical plane, particularly when sudden wind gusts occur. This contributes further to the toy's stability in flight.

Our toy device can also be controlled to perform various maneuvers in flight. Roll is produced by inducing excessive yaw by pulling either the right or left ground control line for rolling to the right or left. This roll action or loop will continue until control compensation is made by returning both right and left ground control lines to their normal positions. This rolling occurs when the change in yaw tilts the axis of rotation of the auto-rotating wing, and thus, its vector of lift. This causes the toy to fly in the direction of said vector and it will therefore commence to roll until a compensating control movement is made.

Roll control is normally a difficult aerodynamic problem since in an inverted and descending roll attitude an autogiro tends to lose its rotation and dive into the ground. In the present invention, this roll control attitude problem was solved in part by the specially designed semi-flexible rudder 16. Since the bridle lines 20 are fixed to opposite sides of the rudder, its air-foil direction during application of yaw control can be precisely controlled. This dual action enables roll to be controlled in both static and dynamic flight. The geometry of the two bridal lines 20, provided by the location of their attachment points, also serves to control the amount of roll during inverted flight or in "loop" and "figure eight" maneuvers by enabling the operator to change the rotational pitch angle of the auto rotating wing 14 to a more perpendicular orientation to the prevailing wind, thereby maintaining its rotational velocity.

From the foregoing, it should be apparent that the present invention provides a toy flying device that is comparatively simple, but unique in structure. Yet, it is capable of unusual and entertaining controllable maneuvers, heretofore not possible with similar prior art devices.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A tethered flying toy adapted to maintain and be maneuvered in flight in a prevailing wind comprising:

a main body member;

means forming a rudder surface at the lower end of said main body member;

tiller means extending outwardly from said main body member near its upper end and terminating at two outer ends located on opposite sides of and forwardly from said body member;

flexible bridle means attached to each of said outer ends of said tiller means and to said lower end of said body member;

rotating wing means having aerodynamically lifting surfaces rotatably attached to the upper end of said main body member above said tiller means;

whereby when control lines attached to said bridle means are used to hold said rotating wing means transverse to the direction of a prevailing wind, said wing means will rotate and produce aerodynamic lift.

2. The flying toy as described in claim 1 wherein the axis of rotating of said wing means is tilted rearwardly from the longitudinal axis of said main body member.

3. The flying toy as described in claim 1 wherein said main body member has an enlarged portion at its upper end, and shaft means journaled in said enlarged portion for supporting said rotating wing means.

4. The flying toy as described in claim 3 wherein said tiller means are fixed to a hub member having bores at opposite ends of a cavity that is open on one side, said enlarged portion of said main body member being adapted to fit within said cavity so that said shaft means extends through said hub member and said enlarged portion.

5. The flying toy as described in claim 4 wherein said cavity of said hub member and said enlarged portion of said main body member has a wedge-shaped cross section.

6. The flying toy as described in claim 1 wherein said main body member has a central section with a T-shaped cross section and said means forming a rudder surface comprises an enlarged integral extension of a flange portion of said central section.

7. The flying toy as described in claim 1 wherein said tiller means comprises a pair of elongated strut members supported at one end on said hub member and diverging forwardly therefrom to opposite sides of said body.

8. The flying toy as described in claim 4 wherein said rotating wing means has a thickened central member with a boss portion having a bore for receiving said shaft, said lifting surfaces extending from opposite sides of said hub member.

9. The flying toy as described in claim 8 wherein said rotating wing means including its said central member and lifting surfaces are formed as one integral component from molded plastic material.

10. The flying toy as described in claim 9 wherein said shaft extends through said rotating wing, said hub member and said enlarged portion of said main body; and removable retainer means attached to one end of said shaft means.

11. The flying toy as described in claim 4 wherein said main body member including its said rudder surface and its said enlarged portion, said hub member and its said tiller means, and said rotating wing are formed as three integral sections from plastic material and are held together by said shaft means.

12. A tethered flying toy adapted to maintain flight and be maneuvered in a prevailing wind comprising:

a first body section having a cavity on one side and integral tiller members extending forwardly and outwardly therefrom;

a second elongated section having a relatively slender central portion, an enlarged head portion at its upper end adapted to fit within said cavity and an integral planar portion at its lower end forming a rudder surface;

a third section comprising a rotatable wing having a thickened central portion and airfoil means extending from said central portion;

shaft means extending through and holding said three sections together;

bridle means connected to said tiller means and said rudder surface; and control line means connected to said bridle means.

* * * * *